US005429170A

United States Patent [19]

Nogaki

[11] Patent Number: 5,429,170

[45] Date of Patent: Jul. 4, 1995

[54] OPERATOR FOR A SLIDING OVERHEAD DOOR

[76] Inventor: Hisami Nogaki, 6465 E. Camino Grande, Anaheim Hills, Calif. 92807

[21] Appl. No.: 106,222

[22] Filed: Nov. 2, 1993

[51] Int. Cl.[6] ..... E05D 15/00

[52] U.S. Cl. ..... 160/201; 160/188

[58] Field of Search ..... 160/201, 188, 209

[56] References Cited

U.S. PATENT DOCUMENTS

| | | | |
|---|---|---|---|
| 2,589,480 | 3/1952 | Curtis | 160/188 |
| 2,794,634 | 6/1957 | Bragg | 160/188 X |
| 3,151,663 | 10/1964 | Bohner et al. | 160/188 X |
| 3,856,073 | 12/1974 | Risser | 160/201 |
| 4,597,428 | 7/1986 | Iha | 160/188 |
| 4,821,456 | 4/1989 | Nogaki | 49/362 |

*Primary Examiner*—Blair M. Johnson
*Attorney, Agent, or Firm*—Natan Epstein

[57] ABSTRACT

An apparatus is provided for operating a segmented sliding overhead door. The door is of the type for sliding in a pair of side tracks mounted at either side of the door between a dosed vertical position and an open horizontal position. A driver is mounted at the side-to-side center of the door and extends away from an interior side of the door. The driver includes a screw drive shaft adapted to be mounted horizontally above the door. A motor is engaged with the drive shaft and provides reversible rotational drive force to the drive shaft. A drive shaft coupling unit engages the drive shaft for moving along the drive shaft in response to rotation of the drive shaft. A track assembly engages and supports the rotating drive shaft and guides the coupling unit in linear travel along the drive shaft. A door connecting rod assembly serves to rigidly jam the door against the floor when the door is in the fully closed position, and connects the carrier unit to the door for moving the door along the side tracks. Preferably, a safety release is included for releasing the connecting rod assembly from the door so that the door may be manually operated. The apparatus is particularly shock resistant.

26 Claims, 3 Drawing Sheets

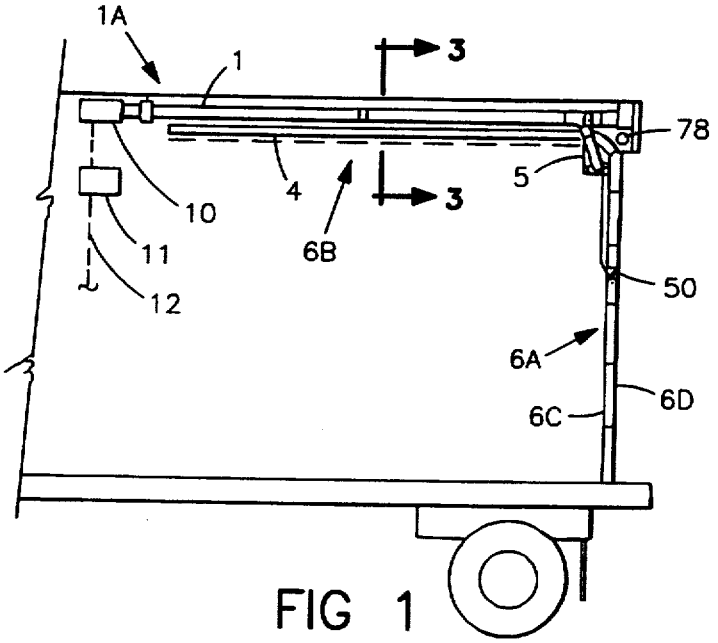
FIG 1
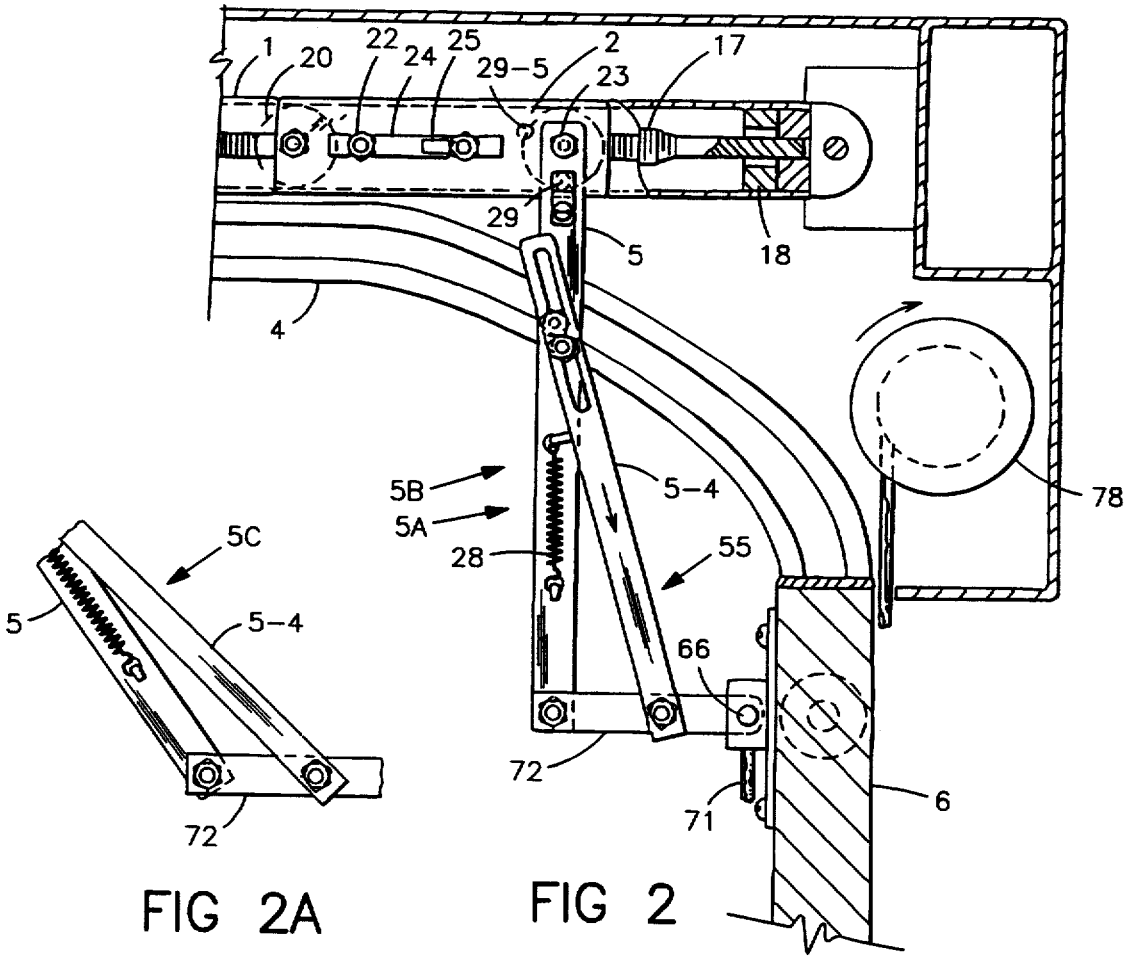
FIG 2A
FIG 2

OPERATOR FOR A SLIDING OVERHEAD DOOR

FIELD OF THE INVENTION

This invention relates generally to automated door operators and, more particularly, is directed towards an automated door operator particularly well suited for use on a cargo vehicle.

BACKGROUND OF THE INVENTION

Mechanical drive units for operating doors and gates exist in the prior art. Such units typically employ limit switches to sense when the door or gate reaches either its fully open or fully closed position, after which they shut off. Such switches add to the complexity, cost, and maintenance of door operating devices. My previous U.S. Pat. No. 4,821,456, hereby incorporated into this application by reference, teaches a linear mechanical drive unit that does not require such limit switches.

While many existing drive units are suitable for low-shock environments, such as found in a typical residential garage, many door operating devices exist in harsh environments that often undergo severe shock and vibration. For example, automated door operators for cargo truck doors frequently experience rough road conditions, harsh loading procedures, and the like. A typical garage door opener adapted to operate a cargo truck door quickly becomes damaged and inoperative. As a result, conventional door operating units are not well-suited for harsh environments.

Clearly, then, there is a need for a rugged, shock-resistant automated door operator that does not require limit switches or other sensitive adjustment mechanisms. Such a needed device would be able to withstand considerable shock and vibration without being damaged, and would expose no mechanisms that are vulnerable to damage by such shock forces. Such a needed device would provide hysteresis between movement of the door and movement of the prime mover of the device in order to provide shock isolation between the door and the prime mover. Further, such a needed device would rigidly lock the door in the closed position, preventing manual opening of the door. However, such a needed device would provide a safety release means for manually opening the door in the event of a power failure, or the like. The present invention fulfills these needs and provides further related advantages.

SUMMARY OF THE INVENTION

The present invention is an operating apparatus for a segmented sliding overhead door. The door is of the type for sliding in a pair of side tracks mounted at either side of the door between a closed vertical position and an open horizontal position. A driver is mounted at the side-to-side center of the door and extends away from an interior side of the door. The driver includes a screw drive shaft adapted to be mounted horizontally above the door. A motor is engaged with the drive shaft and provides reversible rotational drive force to the drive shaft. A drive shaft coupling unit engages the drive shaft for moving along the drive shaft in response to rotation of the drive shaft. A track assembly engages and supports the rotating drive shaft and guides the coupling unit in linear travel along the drive shaft. A door connecting rod assembly serves to rigidly jam the door against the floor when the door is in the fully closed position, and connects the carrier unit to the door for moving the door along the side tracks. Preferably, a safety release is further included for releasing the connecting rod assembly from the door so that the door may be manually operated.

The present invention is a rugged, shock-resistant automated door operator that does not require limit switches or other sensitive adjustment mechanisms. The present device is able to withstand considerable shock and vibration without being damaged, and exposes no mechanisms that are vulnerable to damage by such shock forces. The present invention provides hysteresis between movement of the door and movement of the prime mover of the device in order to provide shock isolation between the door and the prime mover. Further, the present device firmly locks the door in the closed position, preventing manual opening of the door. However, the present invention also provides a safety release means, which may be provided with keyed access, for manually opening the door in the event of a power failure, or the like. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a cross-sectional view of the invention, illustrating the invention as installed for operating a truck cargo bay door; FIG. 2 is a partial, more detailed cross-sectional view of the invention, illustrating a coupling unit and a connecting rod assembly of the invention;

FIG. 2A is a partial side elevational view of the invention, illustrating a first and second connecting rods forming an obtuse angle;

DETAILED DESCRIPTION OF THE PREFERRED EMBODIMENT

Figure 3:
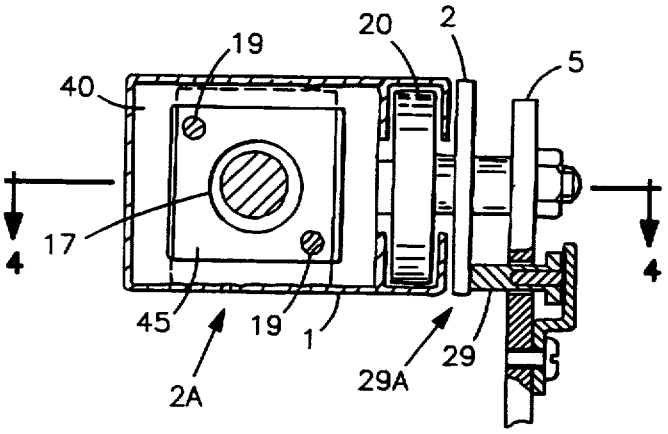
FIG. 3 is a partial cross-sectional view of the invention, taken generally along lines 3—3 of FIG. 1, and illustrating the coupling unit of the invention in more detail.
Figure 4:
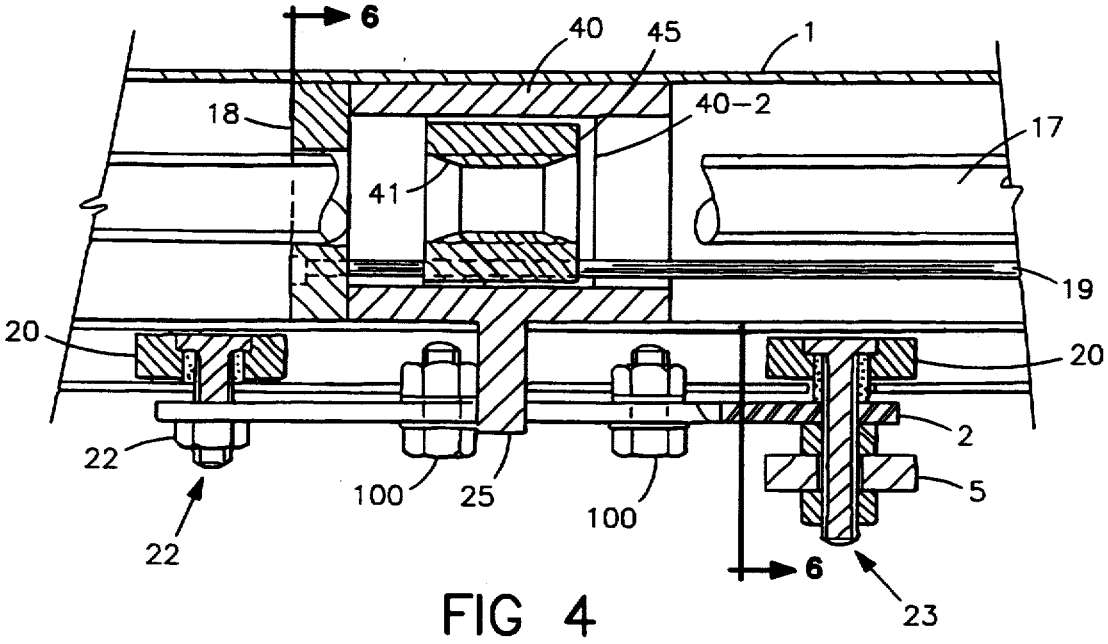
FIG. 4 is a partial cross-sectional view of the invention, taken generally along lines 4—4 of FIG. 3.

FIGS. 1 and 2 show an operating apparatus for a segmented sliding overhead door 6. The door 6 is of the type for sliding in a pair of side tracks 4, mounted at either side of the door 6, between a closed vertical position 6A and an open horizontal position 6B.

A drive means 1A is mounted at the approximate side-to-side center of the door 6 and extends away from an interior side 6C of the door 6. The drive means 1A includes a screw drive shaft 17 adapted to be mounted above the door 6 in an approximately horizontal orientation. A prime mover 10 is engaged with the drive shaft 17 and provides reversible rotational drive force to the drive shaft 17. A drive shaft coupling unit 45 engages the drive shaft 17 for moving along the drive shaft 17 in response to rotation of the drive shaft 17. Preferably, each end of the drive shaft 17 is non-threaded, whereby when the coupling unit 45 reaches either end of the drive shaft 17 the coupling unit 45 is no longer caused to move along the shaft 17. Upon reversal of the rotational direction of the drive shaft 17, the coupling unit 45 engages the screw threads of the drive shaft 17 and is thereby caused to move toward the opposite end of the shaft 17, as taught in my U.S. Pat. No. 4,821,456.

Figure 5:
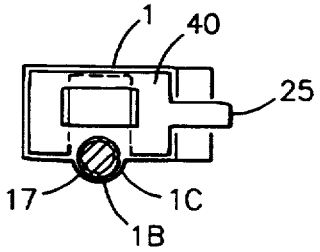
FIG. 5 is a partial cross-sectional view of the invention, taken generally along lines 5—5 of FIG. 4.
Figure 6:
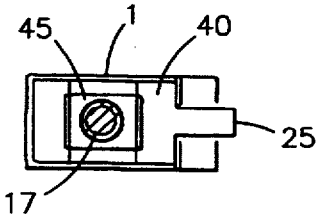
FIG. 6 is a partial cross-sectional view of the invention, taken generally along lines 6'6 of FIG. 4.
Figure 9:
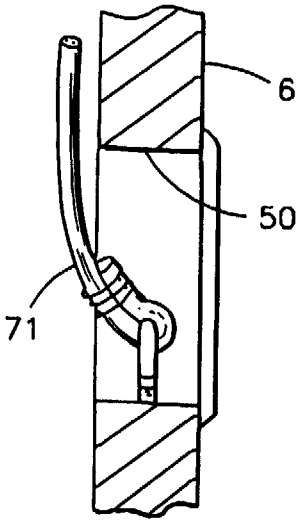
FIG. 9 is a cross-sectional view of the invention, taken generally along lines 9—9 of FIG. 8, illustrating the access hole of FIG. 8 in more detail.
Figure 8:
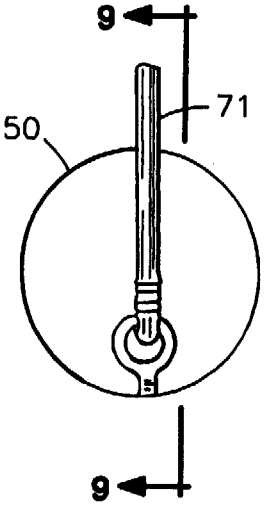
FIG. 8 is a partial front elevational view of the invention, illustrating an access hole in the door and a pull cord connected to the releasing means.
Figure 7:
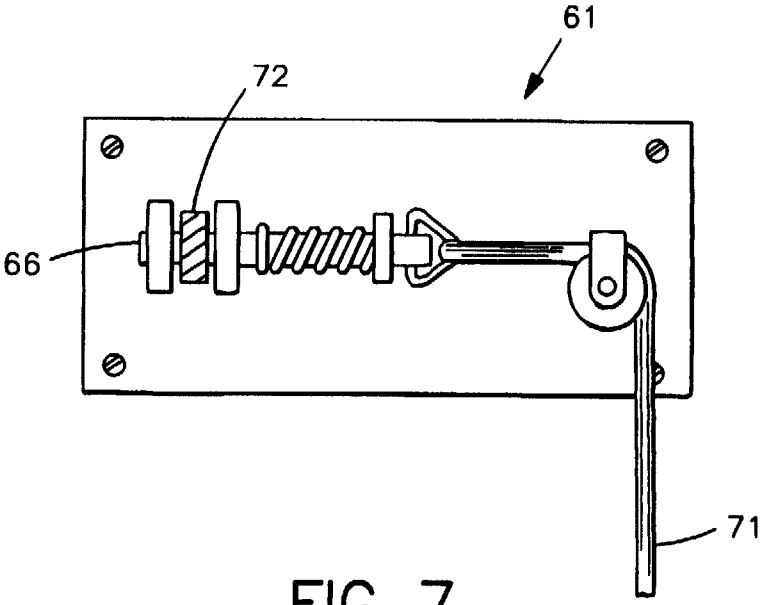
FIG. 7 is a partial front elevational view of the invention, illustrating a releasing means of the invention used to manually release the second connecting rod from the door.

A track assembly 1 engages and supports the rotating drive shaft 17 and guides the coupling unit 45 in linear travel along the drive shaft 17. Preferably, the coupling unit 45 includes a wheel plate 2 supported by at least two wheels 20 engaging the track assembly 1 and moving thereon. The wheel plate 2 has a horizontal slot 24 for engaging a load carrier arm portion 25 of a load carrier unit assembly 40 which contains the coupling unit 45. As such, the wheel plate 2 is shock-isolated from the load carrier arm portion 25 and the wheel plate 2 experiences direction change hysteresis with respect to the load carrier arm 25. Movement adjustment bolts 100 may be used to adjust the operating length of the slot 24. Preferably, the track assembly 1 includes a concave up-facing surface 1C adjacent to the screw shaft 17 for supporting the screw shaft 17 and for providing re-lubrication of the shaft 17 from a lubricant 1B dripping from the shaft 17 onto the surface 1C (FIG. 5).

A pair of shaft supports 18 are preferably included and slidably engaged within the track assembly 1. The shaft supports 18 are spaced apart on either side of the coupling unit 45. Each shaft support 18 has a clearance hole therein for sliding engagement with the shaft 17. The shaft supports 18 are mutually interconnected by at least two shaft support connecting rods 19 arranged in parallel with the shaft 17, whereby flexure of the screw shaft 17 is dampened by the presence of the shaft supports 18 and the connecting rods 19. As such, the screw shaft 17 is less vulnerable to shock forces since the shaft 17 transfers such shock forces to the stronger track assembly through the supports 18. The coupling unit 45, engaged with the shaft 17, presses upon interior walls 40-2 of the load carrier 40, which moves the load carrier arm 25. The load carrier 40 and the coupling unit 45 together thereby provide shock isolation between the door 6 and the prime mover 10. The weight of the door 6 is not loaded onto the load carrier 40 until the prime mover 10 has had a chance to reach its optimal speed and the coupling unit 45 has had a chance to fully engage the threads of the screw shaft 17.

A door connecting rod assembly 5A includes a first straight and rigid connecting rod 5, a second straight and rigid connecting rod 72, and a third straight and rigid connecting rod 5-4. The first connecting rod 5 and the second connecting rod 72 are pivotally engaged end-to-end, while the third connecting rod 5-4 is pivotally joined at both of its ends to the first connecting rod 5 and the second connecting rod 72, respectively. The three rods 5,72,5-4 thereby form the sides of a triangle 55. The third rod 5-4 is slidably engaged to at least one of the first and second rods 5,72 such that the first and second rods 5,72 may mutually pivot from a first position 5B forming an angle therebetween (FIG. 2), to a second position 5C forming an obtuse angle therebetween (FIG. 2A). The third rod 5-4 controls the extent of the maximum obtuse angle achieved in the second position 5C.

An urging means 28, such as a spring, interconnects the third rod 5-4 and one of the first and second rods 5,72 such that the third rod 5-4 is urged to move to open the obtuse angle. The rod assembly 5A is pivotally interconnected between the coupling unit 45 and the door 6 such that with the door 6 in the closed position 6A, the assembly forming a right angle with the first rod 5 in a generally vertical position, and the second rod 72 being in a generally horizontal position, the door 6 is thereby firmly jammed between the rod assembly 5A and the floor. Alternatively, with the door in the open position 6B and the coupling unit 45 being forward of its fully rearward position, the rod assembly 5A follows the coupling unit 45 with the first and second rods 5,72 forming the obtuse angle.

Preferably, a releasing means 61 is further included for releasing the pivotal connection between the second rod 72 and the door 6 so that the door 6 may be manually operated. Such a releasing means 61 includes a sliding removable pivot pin 66 and a pull cord 71 attached thereto and extending downwardly therefrom. The door 6 further includes an access hole 50 therein for the pull cord 71 to extend through for access from an exterior side 6D of the door 6. Clearly, a locking means (not shown) may be included for controlling access to the pull cord 71.

As best illustrated in FIGS. 2 and 3, an engaging means 29A engages the connecting rod assembly 5A with the track assembly 1 so that when the rod assembly 5A is disconnected from the door 6, the rod assembly 5A is forced by the manually opened door 6 into a position above the door 6 for clearance with the door 6. As such, the door 6 may move under the track assembly 1 without contacting the connecting rod assembly 5A. The engaging means 29A preferably includes a spring-loaded pin 29 normally held by the first connecting rod 5 in pressure contact against the wheel plate 2. An engagement hole 29-5 in the wheel plate 2 accepts the pin 29 when the rod assembly 5A is forced into the upward position by the door 6. The pin 29 moves into and engages the engagement hole 29-5 to prevent the rod assembly 5A from dropping after the door 6 is moved away from the rod assembly 5A. The pin 29 is manually slidably retrieved from the engagement hole 29-5 in order to drop the rod assembly 5A for reconnection with the door 6.

In operation, with the door 6 in the closed position 6A, the prime mover 10 is activated, such as by a switch means 11 (FIG. 1) between the prime mover 10 and a power source 12. The switch means 11 may include a simple timing means that activates the prime mover 10 for a duration of time sufficient to either fully open or close the door 6. The prime mover 10 rotates the drive shaft 17 in the direction that causes the coupling unit 45 to contact the load carrier unit assembly 40, which then moves along the track assembly 1 away from the door 6. The load carrier arm 25 of the load carrier unit assembly 40, upon striking the wheel plate 2, causes the wheel plate 2 to move away from the door 6 which, in turn, causes the connecting rod assembly 5A to move from the first position 5B to the second position 5C. Upon reaching the second position 5C, the door 6 is pulled by the connecting rod assembly 5A upward along the side tracks 4, whereby the door moves toward the open position 6B. The reverse process is followed to close the door 6. An optional door urging means 78 may be included (FIG. 2) to counter balance some of the weight of the door 6 during opening and closing of the door 6.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. An operating apparatus for a segmented sliding overhead door of the type for sliding in a pair of tracks mounted at either side of the door between a closed vertical position and an open horizontal position, the apparatus comprising:

a drive means mounted at the approximate side-to-side center of the door and extending away from an interior side of the door, including a screw drive shaft adapted to be mounted above the door, in an approximately horizontal orientation, and a prime mover engaged with the drive shaft and providing reversible rotational drive force to the drive shaft, and a drive shaft coupling unit engaged on the drive shaft for moving along the drive shaft in response to drive shaft rotation;

a track assembly adapted for engagement with the drive shaft, and the coupling unit for supporting the same and for guiding the coupling unit in linear travel along the drive shaft;

a door connecting rod assembly including a first, second and third straight and rigid connecting rods, the first and second of the connecting rods being pivotally engaged end-to-end, while the third of the connecting rods is pivotally joined at its ends to the first and to the second of the connecting rods respectively and thereby joining same, the three rods forming the sides of a triangle, the third of the rods further being slidably engaged to at least one of the first and second of the rods such that the first and second rods may mutually pivot from a first position forming a right angle therebetween, to a second position forming an obtuse angle therebetween, the third of the rods controlling the extent of the maximum obtuse angle achieved in the second position, an urging means interconnecting the third of the rods and one of the first and second of the rods such that the third of the rods is urged to move to open the obtuse angle, further, the rod assembly being pivotally interconnected between the coupling unit and the door such that with the door in the closed position, the coupling unit is at a fully rearward position, the rod assembly forming a right angle with the first of the rods in a generally vertical position and the second of the rods in a generally horizontal position, the door thereby being jammed between the rod assembly and a floor, and with the door in the open position, the coupling unit being forward of the fully rearward position, the rod assembly following the coupling unit with the first and second of the rods forming the obtuse angle.

2. The operating apparatus for a segmented sliding overhead door of the type for sliding in a pair of tracks mounted at either side of the door between a closed vertical position and an open horizontal position of claim 1 wherein the coupling unit includes a wheel plate supported by at least two wheels engaging the track assembly and moving thereon, the wheel plate having a horizontal slot for engaging a load carrier arm portion of a load carrier unit assembly, said unit assembly being engaged with the drive shaft such that the wheel plate is shock isolated from the load carrier arm portion, the wheel plate experiencing direction change hysteresis with respect to the load carrier arm.

3. The operating apparatus for a segmented sliding overhead door of the type for sliding in a pair of tracks mounted at either side of the door between a closed vertical position and an open horizontal position of claim 1 further comprising a means for releasing the pivotal connection between the second rod and the door so that the door may be manually operated.

4. The operating apparatus for a segmented sliding overhead door of the type for sliding in a pair of tracks mounted at either side of the door between a closed vertical position and an open horizontal position of claim 3 wherein the releasing means includes a sliding removable pivot pin and a pull cord attached thereto and extending downwardly, the door further including a hole for the pull cord to extend therethrough for access from an exterior side of the door.

5. The operating apparatus for a segmented sliding overhead door of the type for sliding in a pair of tracks mounted at either side of the door between a closed vertical position and an open horizontal position of claim 1 further comprising a pair of shaft supports slidably engaged within the track assembly and spaced apart on either side of the coupling unit, each of the shaft supports having a clearance hole therein for sliding engagement with the shaft, the shaft supports being mutually interconnected by at least two shaft support connecting rods arranged in parallel with the shaft, whereby screw shaft flexure is dampened by the presence of the shaft supports and the connecting rods.

6. The operating apparatus for a segmented sliding overhead door of the type for sliding in a pair of tracks mounted at either side of the door between a closed vertical position and an open horizontal position of claim 1 wherein the track assembly includes a concave up-facing surface adjacent to the screw shaft for supporting the screw shaft and for providing re-lubrication of the shaft from a lubricant dripping from the shaft onto the surface.

7. The operating apparatus for a segmented sliding overhead door of the type for sliding in a pair of tracks mounted at either side of the door between a closed vertical position and an open horizontal position of claim 2 further comprising a means for engaging the connecting rod assembly with the track assembly so when the rod assembly is disconnected from the door, the rod assembly is forced by the manually opened door into a position above the door for clearance with the door, such that the door moves under the track assembly without contacting the connecting rod assembly.

8. The operating apparatus for a segmented sliding overhead door of the type for sliding in a pair of tracks mounted at either side of the door between a closed vertical position and an open horizontal position of claim 7 wherein the engaging means for engaging the rod assembly with the track assembly includes a spring loaded pin normally held by the first connecting rod in pressure contact against the wheel plate, and an engagement hole in the wheel plate for accepting the pin when the rod assembly is forced into the upward position by the door, the pin moving into and engaging the engagement hole to prevent the rod assembly from dropping after the door is moved away from the rod assembly, the pin being slidably retrieved from the engagement hole in order to drop the rod assembly for reconnection with the door.

9. The operating apparatus for a segmented sliding overhead door of the type for sliding in a pair of tracks mounted at either side of the door between a closed vertical position and an open horizontal position of claim 1 wherein the coupling unit further includes a load carrier containing the coupling unit engaged with the drive screw, the load carrier further including interior walls upon which the coupling unit presses for transferring screw torque to the load carrier and the load carrier arm, the load carrier and coupling unit together providing shock isolation between the door and the prime mover.

10. An operating apparatus for a segmented sliding overhead door moveable along a pair of tracks positioned on either side of a door between a vertical closed position and a horizontal open position, the tracks including a vertical portion and a horizontal portion joined by a curved portion, said apparatus comprising:

drive means mounted between said horizontal portion of said tracks and operable for moving a coupling unit towards and away from said vertical portion;

door connecting means having an upper end connected to said coupling unit and an opposite end connected to said door below said horizontal portion of said tracks;

release means operable for disconnecting said connecting means from said door to permit manual elevation of said door from said closed position to said open position;

characterized in that after disconnection from said door said connecting means are urged upwardly by said door to an out-of-the-way position above said door in response to said manual elevation of said door; and engaging means for retaining said door connecting means in said out-of-the-way position irrespective of the position of said door.

11. An operating apparatus for a segmented sliding overhead door moveable along a pair of tracks positioned on either side of a door between a vertical closed position and a horizontal open position, the tracks including a vertical portion and a horizontal portion joined by a curved portion, said apparatus comprising:

drive means mounted between said horizontal portion of said tracks and operable for moving a coupling unit towards and away from said vertical portion;

door connecting means having an upper end connected to said coupling unit and an opposite end connected to said door below said horizontal portion of said tracks, said door connecting means being pivotable between an L-shaped configuration in said closed position of the door and an elongated generally I-shaped configuration in said open position of said door; and release means operable for disconnecting said connecting means from said door to permit manual elevation of said door from said closed position to said open position;

characterized in that after disconnection from said door said connecting means are urged upwardly by said door to an out-of-the-way position above said door in response to said manual elevation of said door and said connecting means are urged by said door to said I-shaped configuration in response to said manual elevation of said door from said closed position to said open position so as to reduce the space required by said connecting means above said door in said out-of-the-way position.

12. The apparatus of claim 11 wherein said door connecting means assume an elongated configuration to reduce the space required by said connecting means above said door in said out-of-the-way position.

13. The apparatus of claim 11 wherein said door connecting assembly comprises a first member pivoted at an upper end thereof to said coupling unit and having a lower end, a second member having a first end pivoted to said door and a second end pivoted to said lower end, and means for limiting the angular displacement between said first and second member from a generally right angular configuration to an obtuse angular configuration during travel of said door between said open and closed positions in response to movement of said coupling unit.

14. The apparatus of claim 11 wherein said door connecting means are mounted to said coupling unit for movement between a normal condition wherein said connecting means extend below said horizontal portion of said tracks and an out-of-the-way position wherein said connecting means is displaced above said horizontal portion of the tracks to clear passage for said door along said tracks.

15. The apparatus of claim 14 wherein said door connecting means are pivotably mounted to said coupling unit.

16. The apparatus of claim 11 further comprising engaging means for retaining said door connecting means in said out-of-the-way position irrespective of the position of said door.

17. The apparatus of claim 14 wherein said drive means have a screw drive shaft extending parallel to and between said horizontal portion of said tracks and said coupling unit is engaged on said drive shaft for movement therealong in response to rotation of the drive shaft, wherein said door connecting means are pivotably mounted to said coupling unit on one side of said drive shaft, so as to permit said connecting means to pivot between said normal condition and said out-of-the-way position across a plane defined by said horizontal portion of the tracks.

18. A cargo door operating apparatus for a cargo vehicle having a cargo enclosure with a segmented sliding overhead door moveable along a pair of tracks positioned on either side of the door between a vertical closed position and an horizontal open position, the tracks including a vertical portion and a horizontal portion joined by a curved portion, said apparatus comprising;

drive means mounted between said horizontal portion of said tracks and operable for moving a coupling unit towards and away from said vertical portion;

a door connecting assembly pivoted at one end thereof to said coupling unit and connected at an opposite end thereof to an interior side of said door;

release means operable from an exterior side of said door for disconnecting said opposite end from said door to permit manual elevation of said door from said closed position to said open position;

said connecting means being upwardly displaceable by said door to an out-of-the-way position above said door in response to said manual elevation of said door.

19. The apparatus of claim 18 wherein said opposite end hangs freely below said horizontal portion of said tracks after disconnection from said door and is pushed upwardly by said door during manual raising of the door thereby pivoting the door connecting assembly upwardly and out of the path of the door.

20. The apparatus of claim 18 wherein said door connecting assembly has a first configuration when connected to said door in said closed position and assumes a space saving second configuration when displaced to said out-of-the-way position.

21. The apparatus of claim 18 further comprising engaging means operative for retaining said door connecting means in said out-of-the-way position independently of the position of said door.

22. The apparatus of claim 18 wherein said release means comprise a pin normally inserted through aligned holes in said connecting means and said door, and a pull cord attached to said pin and extending to said exterior side of the door.

23. An operating apparatus for a segmented overhead door slideable along a pair of tracks positioned on either side of a door between a vertical closed position and an horizontal open position, the tracks including a vertical portion and a horizontal portion joined by a curved portion, said apparatus comprising:

drive means mounted between said horizontal portion of said tracks and operable for moving a coupling unit towards and away from said vertical portion;

a door connecting assembly comprising a first member pivoted at an upper end thereof to said coupling unit and having a lower end, a second member having a first end pivoted to said door and a second end pivoted to said lower end, and means for limiting the angular displacement between said first and second member from a generally right angular configuration to an obtuse angular configuration during travel of said door between said open and closed positions in response to movement of said coupling unit; and release means operable for disconnecting said second member from said door to allow the door to be manually lifted to said open position along said tracks;

characterized in that manual lifting of said door operates to lift said connecting assembly out of the path of the door and also urges said connecting assembly to said obtuse angular configuration.

24. The apparatus of claim 23 wherein said drive means have a screw drive shaft extending parallel to and between said horizontal portion of said tracks and said coupling unit is engaged on said drive shaft for movement therealong in response to rotation of the drive shaft, wherein said door connecting means are pivotably mounted to said coupling unit on one side of said drive shaft, so as to permit said connecting means to pivot between said normal condition and said out-of-the-way position across a plane defined by said horizontal portion of the tracks.

25. An operating apparatus for a segmented sliding overhead door moveable along a pair of tracks positioned on either side of a door between a vertical closed position and a horizontal open position, the tracks including a vertical portion and a horizontal portion joined by a curved portion, said apparatus comprising:

drive means mounted between said horizontal portion of said tracks and operable for moving a coupling unit towards and away from said vertical portion;

door connecting means having a first member pivoted at an upper end thereof to said coupling unit and having a lower end, a second member having a first end pivoted to said door below said horizontal portion of said tracks and a second end pivoted to said lower end, and means for limiting the angular displacement between said first and second member from a generally right angular configuration to an obtuse angular configuration during travel of said door between said open and closed positions in response to movement of said coupling unit;

release means operable for disconnecting said connecting means from said door to permit manual elevation of said door from said closed position to said open position;

characterized in that after disconnection from said door said connecting means are urged upwardly by said door to an out-of-the-way position above said door in response to said manual elevation of said door.

26. A cargo door operating apparatus for a cargo vehicle having a cargo enclosure with a segmented sliding overhead door moveable along a pair of tracks positioned on either side of the door between a vertical closed position and an horizontal open position, the tracks including a vertical portion and a horizontal portion joined by a curved portion, said apparatus comprising;

drive means mounted between said horizontal portion of said tracks and operable for moving a coupling unit towards and away from said vertical portion;

a door connecting assembly pivoted at one end thereof to said coupling unit and connected at an opposite end thereof to an interior side of said door;

release means operable from an exterior side of said door for disconnecting said opposite end from said door to permit manual elevation of said door from said closed position to said open position;

such that said opposite end hangs freely below said horizontal portion of said tracks after disconnection from said door and is pushed upwardly by said door during manual raising of the door thereby pivoting the door connecting assembly upwardly to an out-of-the-way position out of the path of the door; and engaging means for retaining said door connecting means in said out-of-the-way position irrespective of the position of said door.

* * * * *